US009502001B2

(12) United States Patent
Kim et al.

(10) Patent No.: US 9,502,001 B2
(45) Date of Patent: Nov. 22, 2016

(54) DISPLAY CONTROL METHOD AND APPARATUS FOR POWER SAVING

(71) Applicant: Samsung Electronics Co. Ltd., Suwon-si, Gyeonggi-do (KR)

(72) Inventors: Junghyun Kim, Suwon-si (KR); Dongsub Kim, Suwon-si (KR); Hyunchang Shin, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 529 days.

(21) Appl. No.: 13/938,780

(22) Filed: Jul. 10, 2013

(65) Prior Publication Data

US 2014/0015865 A1 Jan. 16, 2014

(30) Foreign Application Priority Data

Jul. 13, 2012 (KR) ..... 10-2012-0076883

(51) Int. Cl.

*G09G 3/36* (2006.01)
*G09G 5/10* (2006.01)
*G09G 3/34* (2006.01)

(52) U.S. Cl.

CPC ..... *G09G 5/10* (2013.01); *G09G 3/3406* (2013.01); *G09G 3/3607* (2013.01); *G09G 2320/0261* (2013.01); *G09G 2320/062* (2013.01); *G09G 2320/0613* (2013.01); *G09G 2320/0646* (2013.01); *G09G 2320/08* (2013.01); *G09G 2330/021* (2013.01); *G09G 2340/06* (2013.01); *G09G 2354/00* (2013.01); *G09G 2360/144* (2013.01); *G09G 2360/16* (2013.01)

(58) Field of Classification Search

CPC ..... G09G 3/22; G09G 3/34; G09G 3/36; G09G 3/3607; G09G 3/3611; G09G 3/364

USPC ..... 345/83, 84, 87, 89, 204, 690

See application file for complete search history.

(56) References Cited

U.S. PATENT DOCUMENTS

| | | | | |
|---|---|---|---|---|
| 2008/0049047 | A1 | 2/2008 | Credelle et al. | |
| 2008/0084524 | A1 | 4/2008 | Inuzuka et al. | |
| 2009/0059078 | A1 | 3/2009 | Kim et al. | |
| 2009/0135207 | A1* | 5/2009 | Tseng | G09G 3/3607 345/690 |
| 2009/0140971 | A1 | 6/2009 | Hernandez et al. | |
| 2010/0259556 | A1* | 10/2010 | Inuzuka | G09G 3/3611 345/604 |
| 2011/0109658 | A1 | 5/2011 | Park | |

(Continued)

FOREIGN PATENT DOCUMENTS

| | | | |
|---|---|---|---|
| DE | 102009016420 | A1 | 10/2010 |
| EP | 1780991 | A1 | 5/2007 |
| JP | 2008-065185 | A | 3/2008 |

(Continued)

*Primary Examiner* — Jennifer Nguyen
(74) *Attorney, Agent, or Firm* — Jefferson IP Law, LLP

(57) ABSTRACT

A display control method and an apparatus for power saving of a display unit are provided. The method includes, determining a display mode in response to input of external illumination data, detecting input of a Red-Green-Blue-White (RGBW) data frame, applying a weight corresponding to the determined display mode to at least a White (W) sub-pixel value among pixel values of the RGBW data frame, determining luminance control data using the pixel values to which the weight is applied; and controlling the lighting system to output light based on the determined luminance control data, and controlling the display panel to transmit the light based on the determined luminance control data.

13 Claims, 11 Drawing Sheets

(56) References Cited

U.S. PATENT DOCUMENTS

2011/0181627 A1 7/2011 You et al.
2011/0267381 A1 11/2011 Yamazaki et al.

FOREIGN PATENT DOCUMENTS

JP 2010-249859 A 11/2010
KR 2009-0021598 A1 3/2009

* cited by examiner

DISPLAY CONTROL METHOD AND APPARATUS FOR POWER SAVING

PRIORITY

This application claims the benefit under 35 U.S.C. §119 (a) of a Korean patent application filed on Jul. 13, 2012 in the Korean Intellectual Property Office and assigned Serial No. 10-2012-0076883, the entire disclosure of which is hereby incorporated by reference.

BACKGROUND OF THE INVENTION

1. Field of the Invention

The present invention relates to a display control method and an apparatus. More particularly, the present invention relates to a method for power saving of a display unit and an apparatus thereof.

2. Description of the Related Art

In general, an array scheme of a pixel is classified into a real stripe scheme and a pentile scheme. According to the real strip scheme, one pixel is configured by three sub-pixels—Red (R), Green (G), and Blue (B) sub-pixels. The pixels including sub-pixels are arrayed on a display unit.

In contrast to the real stripe scheme, the pentile scheme includes an RGBG scheme in which red, green, and blue sub-pixels are arrayed in a ratio of 1:1:2 (RGBG) using a characteristic that a human less recognizes the blue and more recognizes the green. Although resolution in the pentile RGB scheme is reduced relative to a real stripe scheme, the yield can be improved, a manufacturing cost can be reduced, and high resolution can be implemented with a small screen.

According to the related art, some schemes may include a White (W) sub-pixel.

The pentile RGBW scheme uses a physical characteristic requiring a lighting unit (e.g., back light unit) in a case of a liquid crystal display (LCD). For example, the pentile RGBW scheme increases an area of a sub-pixel 1.5 times instead of reducing a density of the sub-pixel relative to the real stripe scheme. In addition, the pentile RGBW scheme uses four types of sub-pixels including red, green, blue and white. In detail, the white pixel is a transparent sub-pixel. In an LCD using an RGB scheme, when a lighting unit is turned-on in a state that sub-pixels of an RGB have maximum transmittance, light of the lighting unit transmits the LCD so that white is displayed. In an LDC using the pentile RGBW scheme, a white pixel located between red, green, and blue sub-pixels transmits light of the lighting unit according to the transmittance. Accordingly, the pentile RGBW scheme may display an image of high luminance with the same power relative to the real stripe scheme.

A main advantage associated with using the pentile RGBW scheme is power saving of the lighting unit. One of important issues in an electronic device, particularly, a portable terminal is power saving. Accordingly, in recent years, the pentile RGBW scheme has a tendency to be used in portable terminals. Because sub-pixels of RGB in the pentile RGBW scheme are insufficient relative to the real stripe scheme, the pentile RGBW scheme has a side effect in that image quality (e.g., color tone) is lowered. Accordingly, in the pentile RGB scheme according to the related art, a register value (e.g., weight endowed by sub-pixels) for controlling the display unit with respect to improvement in image quality is preferentially set relative to a register value with respect to power saving. However, in an environment that does not require an improvement in the image quality (e.g., bright peripheral environment or moving image viewing), the main advantage associated with using the pentile RGBW scheme cannot be properly obtained.

Therefore, a need exists for a system and method for saving power consumption of a lighting unit while maintaining recognized image quality by dynamically controlling a display unit in response to at least one of variation in peripheral illumination (e.g., motion from indoor to outdoor) and variation in an image attribute.

The above information is presented as background information only to assist with an understanding of the present disclosure. No determination has been made, and no assertion is made, as to whether any of the above might be applicable as prior art with regard to the present invention.

SUMMARY OF THE INVENTION

Aspects of the present invention are to address at least the above-mentioned problems and/or disadvantages and to provide at least the advantages described below. Accordingly, an aspect of the present invention is to provide a method and an apparatus capable of saving power consumption of a lighting unit while maintaining recognized image quality by dynamically controlling a display unit in response to at least one of variation in peripheral illumination (e.g., motion from indoor to outdoor) and variation in an image attribute.

In accordance with an aspect of the present invention, a display control method of a device including a pentile Red-Green-Blue-White (RGBW) type display panel and a lighting system providing light to the display panel is provided. The method includes determining a display mode in response to input of external illumination data, detecting input of an RGBW data frame, applying a weight corresponding to the determined display mode to at least White (W) sub-pixel value among pixel values of the RGBW data frame, determining luminance control data using the pixel values to which the weight is applied, controlling the lighting system to output light based on the determined luminance control data, and controlling the display panel to transmit the light based on the determined luminance control data.

In accordance with another aspect of the present invention, a display control method of a device including a pentile RGBW type display panel and a lighting system providing light to the display panel is provided. The method includes, detecting input of an RGBW data frame, determining whether an attribute of the RGBW data frame is a moving image in response to the input of the RGBW data frame, determining that a display mode corresponds to a moving image playing mode when the attribute of the RGBW data frame is the moving image, applying a weight corresponding to the moving image playing mode to at least W sub-pixel value among sub-pixel values of pixel values of the RGBW data frame, determining luminance control data using pixel values to which the weight is applied, controlling the lighting system to output light based on the determined luminance control data, and controlling the display panel to transmit the light based on the determined luminance control data.

In accordance with another aspect of the present invention, a display control method of a device including a pentile RGBW type display panel and a lighting system providing light to the display panel is provided. The method includes executing an application for playing a moving image, determining a display mode as a moving image playing mode in response to the execution of the application, detecting input of an RGB data frame, applying a weight corresponding to the moving image playing mode to at least W sub-pixel value among pixel values of the RGBW data frame, determining luminance control data using the pixel values to which the weight is applied, controlling the lighting system to output light based on the determined luminance control data, and controlling the display panel to transmit the light based on the determined luminance control data.

In accordance with another aspect of the present invention, a display control method of a device including a pentile RGBW type display panel and a lighting system providing light to the display panel is provided. The method includes detecting input of external illumination data, displaying a mode setting screen when the external illumination data exceeds a threshold for determining an outdoor visibility mode, detecting selection of the outdoor visibility mode from the mode setting screen, determining that the display mode corresponds to the outdoor visibility mode in response to the selection of the outdoor visibility mode, and controlling the display panel to increase transmittance of a W sub-pixel and controlling the lighting system to increase luminance in response to the determining that the display mode corresponds to the outdoor visibility mode.

In accordance with another aspect of the present invention, a display control apparatus is provided. The apparatus includes a display unit for including a pentile RGBW type display panel and a lighting system for providing light to the display panel, an image processor for adjusting transmittance of the display panel, an optical sensor for detecting external illumination, and a controller for controlling the display unit, the image processor, and the optical sensor, wherein the controller is configured to determine a display mode in response to input of the external illumination, to apply a weight corresponding to the determined display mode to at least W sub-pixel value among sub-pixel values of pixel values of RGBW data frame input from the image processor, to determine luminance control data using the pixel values to which the weight is applied, to control the lighting system to output light based on the determined luminance control data, and to control the display panel to transmit the light based on the determined luminance control data.

In accordance with another aspect of the present invention, a display control apparatus is provided. The apparatus includes a display unit for including a pentile RGBW type display panel and a lighting system for providing light to the display panel, an image processor for adjusting transmittance of the display panel, and a controller for controlling the display unit, and the image processor, wherein the controller is configured to determine that a display mode corresponds to a moving image playing mode when an attribute of an RGBW data frame inputted from the image processor is a moving image, to apply a weight corresponding to the moving image playing mode to at least W sub-pixel value among sub-pixel values of pixel values of the RGBW data frame, to determine luminance control data using the pixel values to which the weight is applied, to control the lighting system to output light based on the determined luminance control data, and to control the display panel to transmit the light based on the determined luminance control data.

In accordance with another aspect of the present invention, a display control apparatus is provided. The apparatus includes a display unit for including a pentile RGBW type display panel and a lighting system for providing light to the display panel, an image processor for adjusting transmittance of the display panel, and a controller for controlling the display unit, and the image processor, wherein the controller is configured to determine that a display mode corresponds to a moving image playing mode in response to execution of an application for playing a moving image, applies a weight corresponding to the moving image playing mode to at least W sub-pixel value among sub-pixel values of pixel values of the RGBW data frame inputted from the image processor, determines luminance control data using the pixel values to which the weight is applied, controls the lighting system to output light based on the determined luminance control data, and controls the display panel to transmit the light based on the determined luminance control data.

In accordance with another aspect of the present invention, a display control apparatus is provided. The apparatus includes a display unit for including a pentile RGBW type display panel and a lighting system for providing light to the display panel, an image processor for adjusting transmittance of the display panel, an optical sensor for detecting external illumination, and a controller for controlling the display unit, the image processor, and the optical sensor, wherein the controller is configured to control the display unit to display a mode setting screen when external illumination data from the optical sensor exceed a threshold for determining an outdoor visibility mode, to detect selection of the outdoor visibility mode from the mode setting screen, to determine a display mode as the outdoor visibility mode in response to the selection of the outdoor visibility mode, to control the display panel to increase transmittance of a W sub-pixel, and to control the lighting system to increase luminance through the image processor in response to the determining of the outdoor visibility mode.

In accordance with another aspect of the present invention, a non-transitory computer-readable recoding medium implemented by a device including a pentile RGBW type display panel and a lighting system providing light to the display panel is provided. The recoding medium storing instructions that, when executed, causes at least one processor to perform a method which includes determining a display mode in response to input of external illumination data, detecting input of an RGBW data frame, applying a weight corresponding to the determined display mode to at least W sub-pixel value among sub-pixel values of pixel values of the RGBW data frame, determining luminance control data using the pixel values to which the weight is applied, controlling the lighting system to output light based on the determined luminance control data, and controlling the display panel to transmit the light based on the determined luminance control data.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

Figure 1:
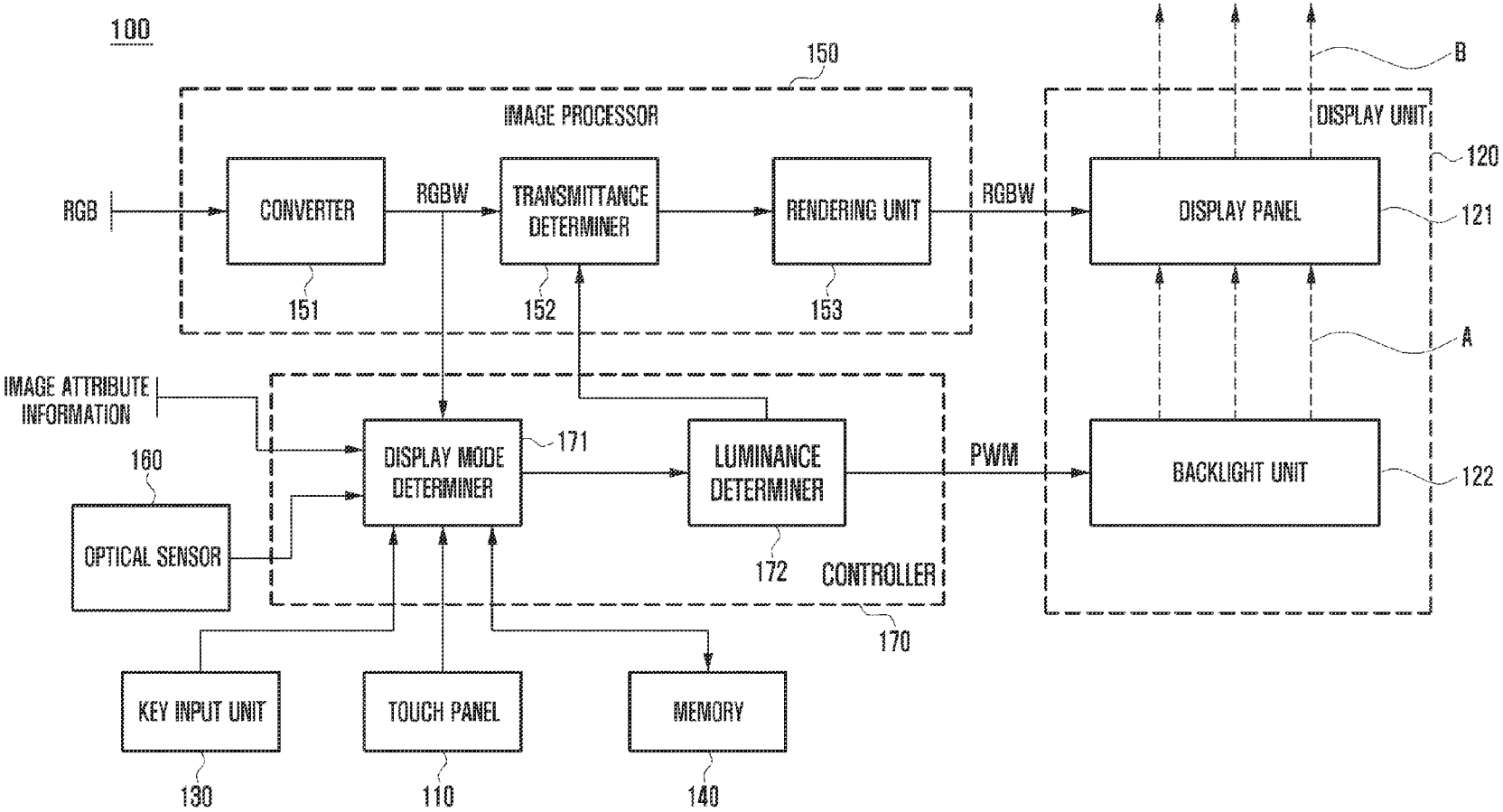
FIG. 1 is a block diagram illustrating a configuration of a display control apparatus according to an exemplary embodiment of the present invention.

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The display control method and apparatus according to exemplary embodiments of the present invention are applied to a terminal having a lighting system to display an image. For example, the terminal is applicable to a multi-media device such as a smart phone, a tablet Personal Computer (PC), a notebook PC, a desktop PC, a TV, a navigation device, a video phone, and the like. The display control method and apparatus according to the present invention are applicable to a device (e.g., refrigerator having a communication function and a touch screen, and the like) to which the multi-media device is converged.

Hereinafter, the display control method and apparatus according to exemplary embodiments of the present invention will be described in detail. Detailed descriptions of well-known functions and structures incorporated herein may be omitted to avoid obscuring the subject matter of exemplary embodiments of the present invention. Hereinafter, the lighting system is a backlight unit. However, exemplary embodiments of the present invention are not limited thereto. For example, the lighting system includes various devices such as a white LED.

According to exemplary embodiments of the present invention, a Red-Green-Blue (RGB) data frame is one image displayed on the display unit. For example, the RGB data frame may be one still image in a moving image or photograph or application execution screen (e.g., web browser screen). The RGB data frame has various resolutions. For example, the RGB data frame may comprise 4,096,000 pixel values (vertical: 1600, horizontal: 2560). The pixel value may be associated with transmittance of a pixel (degree of light emitted from backlight unit transmitting a pixel of a display panel). The pixel value has a Red (R) sub-pixel value, Green (G) sub-pixel value, and a Blue (B) sub-pixel value. For example, the sub-pixel value may have the range from 0 to 210 (1024). For example, when the sub-pixel value is 1024, transmittance of a corresponding sub-pixel is determined as 100%. When the pixel value is 0, the transmittance of the corresponding sub-pixel value is determined as 0%. The RGBW data frame includes a White (W) sub-pixel value in addition to an R sub-pixel value, a G sub-pixel value, and a B sub-pixel value. The RGB data frame may be converted into an RGBW data frame. The conversion of the RGB data frame to the RGBW data frame is well known art in the pentile RGBW scheme according to the related art.

According to exemplary embodiments of the present invention, luminance control data are information for controlling luminance of the backlight unit output from the controller of the apparatus. Brightness of light output from the backlight unit may be determined based on luminance control data. For example, the luminance control data may be a Pulse Width Modulation (PWM) signal associated with current (mA) consumed in the backlight unit. The luminance control data may be a ratio of present current consumption to maximum current consumption.

FIG. 1 is a block diagram illustrating a configuration of a display control apparatus according to an exemplary embodiment of the present invention.

Referring to FIG. 1, a display control apparatus 100 may include a touch panel 110, a display unit 120, a key input unit 130, a memory 140, an image processor 150, an optical sensor 160, and a controller 170.

The touch screen includes a touch panel 110 and a display unit 120 in order to provide a user interface for mutual operation with the user.

The touch panel 110 generates an analog signal (e.g., touch event) in response to a user gesture with respect to the touch panel 110, converts the analog signal into a digital signal, and transfers the digital signal to the controller 170. The touch event may include touch coordinates (x, y). For example, a controller 170 of the touch panel 110 determines a representative among a plurality touch coordinates, and transfers the determined touch coordinates to the controller 170. The control may be performed by the controller 170. When touch coordinates are received from the touch panel 110, the controller 170 determines that a touch input tool (e.g., finger or pen) is touched on the touch panel 110. When the touch coordinates are not received from the touch panel 110, the controller 170 determines that touch of the touch input tool is released. When touched coordinates are changed from (x0, y0) to (x1, y2), and the change amount (e.g., D, where $D^2=(x0-x1)^2+(y0-y1)^2$) exceeds a preset "movement threshold (e.g., 1 mm)", the controller 170 determines that the touch input tool is moved. The controller 170 computes location change amounts (dx, dy) and moving speed in response to movement of the touch input tool.

The controller 170 may include a display mode determiner 171 and a luminance determiner 172.

The controller 170 determines that the user gesture is touch, multi-touch, tap, double tap, long tap, tap and touch, drag, flick, press, pinch in, pinch out, and the like based on touch coordinates, presence of touch release and movement of the touch input tool, a location change amount, and a moving speed of the touch input tool. The touch may correspond to an operation in which a user contacts on one point of the touch panel 110 by the touch input tool. The multi-touch may correspond to a gesture by which the user contacts multiple of points on the touch panel 110 by a plurality of touch input tools (e.g., thumb and index fingers). The tap may correspond to a gesture by which the user touches-off a corresponding point without movement after touching the touch input tool on one point. The double tap may correspond to a gesture by which a user continuously taps one point twice. The long tap may correspond to a gesture by which touch of the touch input tool is released from a corresponding point without a motion of the touch input tool after touching one point longer than the tap. The tap and touch may correspond to a gesture by which the user again touches a corresponding point within a predetermined time (e.g., 0.5 seconds) after tapping one point of the screen. The drag may correspond to a gesture that moves the touch input tool in a predetermined direction in a state that one point is touched. The flick may correspond to a gesture that releases the touch after rapidly moving a touch input tool as compared with the drag. The press may correspond to a gesture that maintains touch without movement for a predetermined time (e.g., 2 seconds) or longer after touching one point. The pinch in may correspond to a gesture that reduces intervals between touch input tools after simultaneously multi-touching on two points by two touch input tools. The pinch out may correspond to a gesture that increases intervals between touch input tools. For example, the touch may correspond to a gesture in which the user contacts the touch panel 110, and other gestures refer to variation in the touch.

The touch panel 110 may be a composite touch panel including a hand touch panel for detecting a hand gesture and a pen touch panel for detecting a pen gesture. The hand touch panel may be configured by a capacitive type a resistive type, an infrared type, an ultrasonic type, and the like. The hand touch panel may generate a touch event not only by only a hang gesture of the user but also by other object (e.g., conductive object capable of representing variation in capacitance). The pen touch panel may be configured by an electromagnetic induction type. Accordingly, the pen touch panel generates the touch event by a stylus panel for touch specifically manufactured to create a magnetic field.

The display unit 120 includes a display panel 121 converting an image from the image processor 150 into an analog signal and displaying the analog signal, and a backlight unit 122 providing light having a first luminance A to the display panel 121, under control of the controller 170. The display panel 121 may be configured in the form of a flat display panel such as Liquid Crystal Display (LCD) or the like. The display panel may have a second luminance B. As described above, pixels of the display panel 121 are arrayed in the pentile RGBW scheme. The display unit 120 may display various screens such as a lock screen, a home screen, an application (hereinafter referred to as 'App') execution screen, a key pad screen, and the like according to use of the display control apparatus 100. If the display unit 120 is turned-on by the controller 170, the lock screen may be defined as an image displayed on the display unit 120. If a touch gesture corresponding to a lock release is detected, the controller 170 may change the displayed image from the lock screen to a home screen or an App execution screen. The home screen may correspond to an image including a plurality of App icons corresponding to a plurality of Apps. If the user selects one App icon from a plurality of App icons (e.g., by tapping an icon), the controller 170 may execute a corresponding App, for example, a moving image player, and display an execution screen on the display unit 120.

The key input unit 130 may include a plurality of input keys and function keys for receiving input of numerals or character information, and setting various functions. The function keys may include arrow keys, side keys, and hot keys set to perform a certain function. Further, the key input unit 130 generates and transfers key signals associated with user setting and function control of the display control apparatus 100 to the controller 170. The key signals may include a power on/off signal, a volume control signal, a screen on/off signal, and the like. The controller 170 controls the foregoing structural elements according to the key signals. The key input unit 130 may be implemented by a Qwerty key pad, a 3*4 key pad, a 4*3 key pad, and the like having a plurality of keys. Further, when a touch panel 110 is supported in the form of a full touch screen, the key input unit 130 may include at least one side key for screen on/off and on/off of the display control apparatus 100, which is provided at a side of a case of the display control apparatus 100.

The memory 140 may store data (e.g., images) generated by the display control apparatus 100 according to use of the display control apparatus 100 or downloaded from the outside. The memory 140 may store the screens. The memory 140 may store various preset values (e.g., a preset value for determining transmittance and a preset value for determining luminance of the backlight unit 122) for the operation of the display control apparatus 100.

The memory 140 stores various programs. In detail, the memory 140 may include an Operating System (OS) for operating booting of the display control apparatus 100, a communication program, an image processing program, a display control program, a user interface program, an embedded application, and a 3rd party application. The communication program includes commands capable of communicating with an external device through a wireless communication unit. The image processing program includes various software constituent elements (e.g., an image conversion module, a transmittance determining module, an image rendering module, and the like) for processing an image to be displayed on the touch screen. The image may include a text, a web page, an icon, a picture, video, animation, and the like. The display control program includes various software constituent elements (e.g., a display mode determining module and a luminance determining module) for controlling image quality (e.g., brightness) of an image displayed on a touch screen. The display mode may be classified into various modes according to external illumination data detected by the optical sensor 160. For example, the display mode may include a normal mode and an outdoor visibility mode. For example, when external illumination data are 20K lux (lx) or higher, the display mode is determined as the outdoor visibility mode. When the external illumination data are lower than 20K lux (lx), the display mode may be determined as the normal mode. For example, the normal mode may include a basic mode, a first power saving mode, and a second power saving mode. For example, external illumination data is higher than 1K lux and lower than 20K lux, the display mode may be determined as the second power saving mode. When the external illumination data are greater than 75 lux and lower than 1.5K lux, the display mode may be determined as the first power saving mode. When the external illumination data are less than 150 lux, the display mode may be determined as the basic mode. Meanwhile, the display mode may be determined regardless of the external illumination data. For example, when an image to be displayed on the touch screen is a still image from a moving image, the display mode may be determined as a moving image playing mode. The moving image playing mode may be the same as the first power saving mode or the second power saving mode. The user interface program includes various software constituent elements associated with a user interface. The embedded application corresponds to an application which is basically mounted in the display control apparatus 100. For example, the embedded application may be a browser, an e-mail, an instant messenger, and the like. The 3rd party application corresponds to an application which may be downloaded and installed in the display control apparatus 100 from an on-line market. The 3rd party application is freely installed and removed. For example, the 3rd party application may be Facebook, Twitter, and the like.

The image processor 150 converts an RGB data frame into an RGBW data frame and outputs the RGBW data frame to the display panel 121 under control of the controller 170. In detail, the image processor 150 may include a converter 151, a transmittance determiner 152, and a rendering unit 153.

The converter 151 converts the RGB data frame into the RGBW data frame and outputs the RGBW data frame to the transmittance determiner 152 and the controller 170.

The transmittance determiner 152 receives information (e.g., display mode change information or luminance change information) associated with the luminance of the backlight unit 122 from the controller 170. The transmittance determiner 152 determines transmittance of each pixel of the display panel 121 based on the information. The transmittance determiner 152 adjusts pixel values (e.g., particularly the W sub-pixel value) of the RGBW data frame based on the information. An effect according to the control of the W sub-pixel value will be described with reference to FIGS. 2 and 3.

Figure 2:
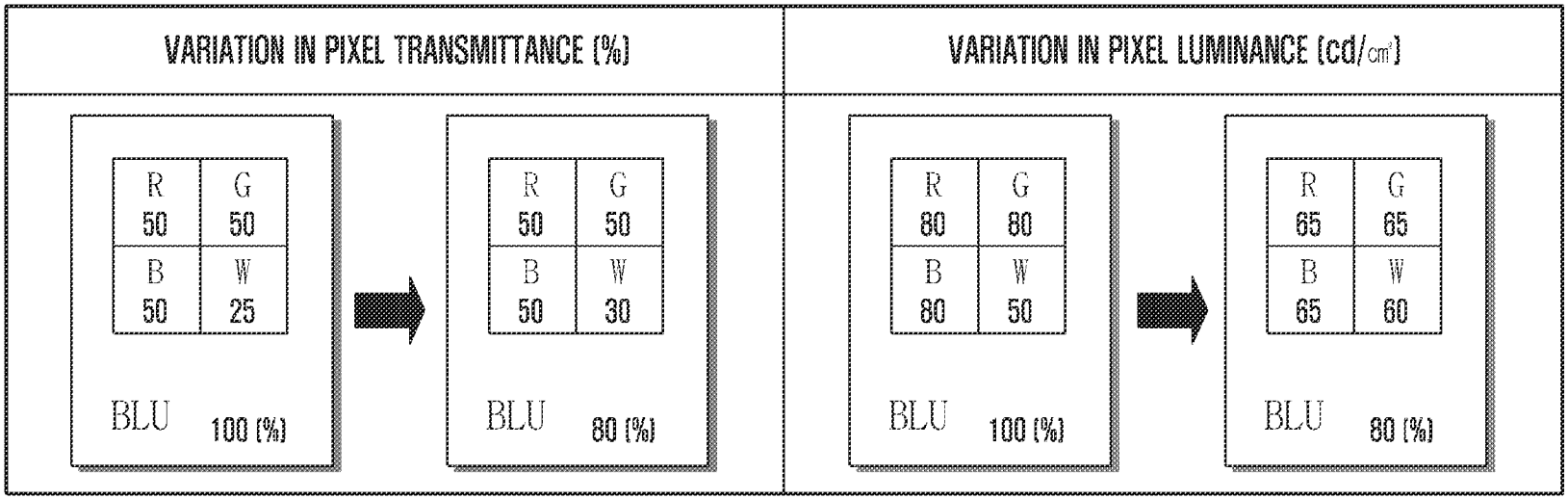
FIGS. 2 and 3 are exemplary diagrams illustrating variation in transmittance and variation in luminance according to an exemplary embodiment of the present invention.
Figure 3:
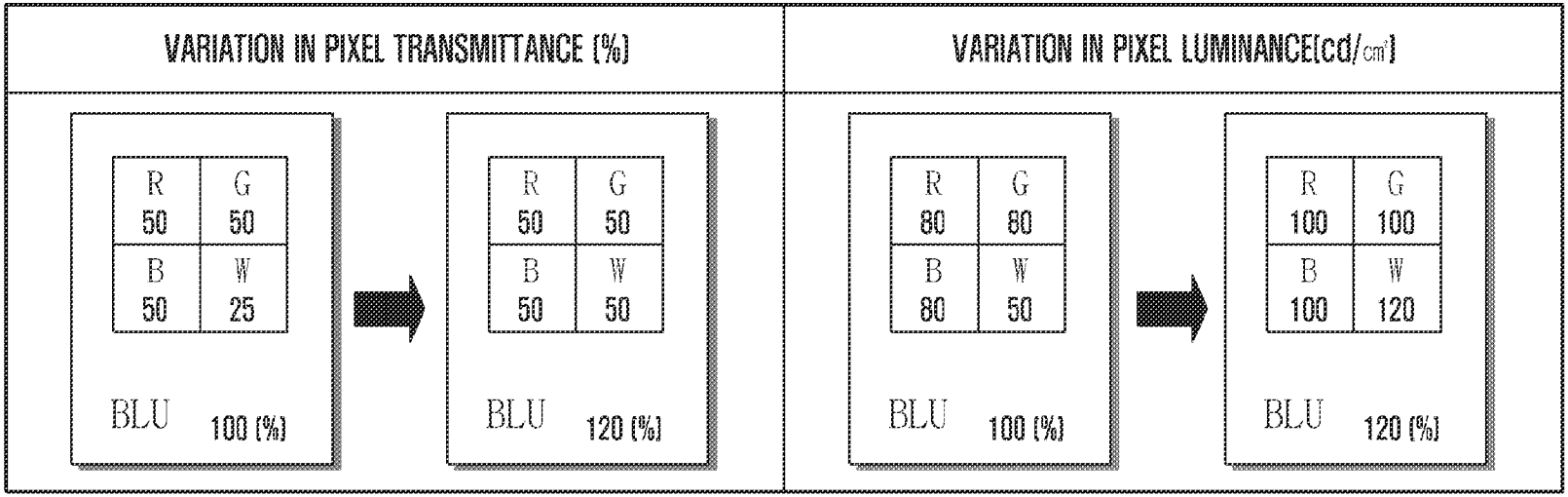

FIGS. 2 and 3 are exemplary diagrams illustrating variation in transmittance and variation in luminance according to an exemplary embodiment of the present invention.

Referring to FIG. 2, when the display mode is changed from the basic mode to the power saving mode, current consumption in the backlight unit 122 is reduced (e.g., by 20(100→80) %), and accordingly first luminance A of the backlight unit 122 may be reduced. In this case, the transmittance determiner 152 maintains RGB sub-pixel values as it is (e.g., transmittance of an RGB sub-pixel maintains, for example, 50%). Instead, the transmittance determiner 152 increases a W sub-pixel value (e.g., increases the transmittance of the W sub-pixel, for example, from 25% to 30%). For example, luminance of light transmitting RGB pixels may be reduced from 80 cd/cm$^2$ to 65 cd/cm$^2$, but luminance of light transmitting a W pixel may be increased from 50 cd/cm$^2$ to 60 cd/cm$^2$. Accordingly, total luminance of light transmitting a corresponding pixel may be maintained equally to before the change of a mode. As described above, when the first luminance A of the backlight unit 122 is reduced, the transmittance determiner 152 may increase transmittance of the W sub-pixel so that a second luminance B of the display panel 121 may be maintained. As shown in FIG. 1, the first luminance A and the second luminance B respectively correspond to luminance of light output from the backlight unit 122 and the display panel 121.

Referring to FIG. 3, when the display mode is changed from the basic mode to the outdoor visibility mode, the current consumed in the backlight unit 122 may be increased (e.g., an increase of 20% such as an increase from 100 cd/cm$^2$ to 120 cd/cm$^2$), and accordingly the first luminance A of the backlight unit 122 may be increased. In this case, the transmittance determiner 152 maintains RGB sub-pixel value as it is (e.g., transmittance of the RGB sub-pixel is maintained at 50%). In this case, the transmittance determiner 152 increases the transmittance of a W sub-pixel. For example, the transmittance of the W sub-pixel is increased from 25% to 50%. As the image quality is improved, for example, the luminance of light transmitting the RGB sub-pixels is increased from 80 cd/cm$^2$ to 100 cd/cm$^2$. For example, the luminance of the light transmitting the W sub-pixel is increased from 50 cd/cm$^2$ to 120 cd/cm$^2$. For example, an increased width of the transmittance of the W sub-pixel is greater than that of other sub-pixels. Accordingly, total luminance of light transmitting a corresponding pixel is additionally increased. As described above, when the first luminance A of the backlight unit 122 is increased, the transmittance determiner 152 further increases the transmittance of the W sub-pixel greater than RGB sub-pixels so that the second luminance B of the display panel 121 is increased more.

The rendering unit 153 renders an RGBW data frame received from the transmittance determiner 152 and outputs the rendered RGBW data to the display panel 121.

The image processor 150 may include constituent elements which are not described above. For example, the image processor 150 may further include a dithering unit for compensating a demerit resulting from a difference of a color space of the RGBW data frame output from the rendering unit 153, and for outputting the compensated result to the display panel 121. Specific constituent elements in the image processor 150 may be excluded from the foregoing constituent elements according to a provision form. When data input to the image processor 150 are RGBW data frame, the converter 151 may be omitted.

The optical sensor 160 detects external illumination and outputs the detected external illumination to the controller 170 under control of the controller 170.

The controller 170 controls an overall operation of the display control apparatus 100 and signal flow between internal constituent elements, and processes data. The controller 170 controls power supply of the battery to the internal constituent elements. The controller 170 may include a display mode determiner 171 and a luminance determiner 172. The display mode determiner 171 may detect input of external illumination data, and determine a display mode of the display control apparatus 100 in response to the external illumination data. For example, the display mode determiner 171 may determine the display mode as one of the foregoing modes (e.g., the basic mode, the first power saving mode, the second power saving mode, and the outdoor visibility mode). The display mode determiner 171 detects input of the RGBW data frame, and determines whether an attribute of the input RGBW data frame is a moving image. When the attribute of the input RGBW data frame is a moving image, the display mode determiner 171 may determine the display mode as a moving image playing mode. When an App for playing the moving image is executed, the display mode determiner 171 may determine the display mode as the moving image playing mode. The luminance determiner 172 determines the first luminance A of the backlight unit 122 in response to the determined display mode. The luminance determiner 172 outputs information (e.g., mode change information or luminance change information) associated with the determined first luminance A to the transmittance determiner 152. The luminance determiner 172 outputs luminance control data associated with the determined first luminance A to the backlight unit 122. Functions of the controller 170 will be described in detail.

Because the structural elements can be variously changed according to convergence trend of a digital device, no elements can be listed. However, the display control apparatus 100 may further include constituent elements which are not described such as a Radio Frequency (RF) communication unit, a broadcasting receiver (e.g., a Digital Multimedia Broadcasting (DMB) module), a Global Positioning Service (GPS) receiver, a speaker, a microphone, a camera for voice call, image call, or data communication, and the like. Further, specific elements in the foregoing constructions of the display control apparatus 100 may be omitted or substituted by another element according to the provided form.

Figure 4:
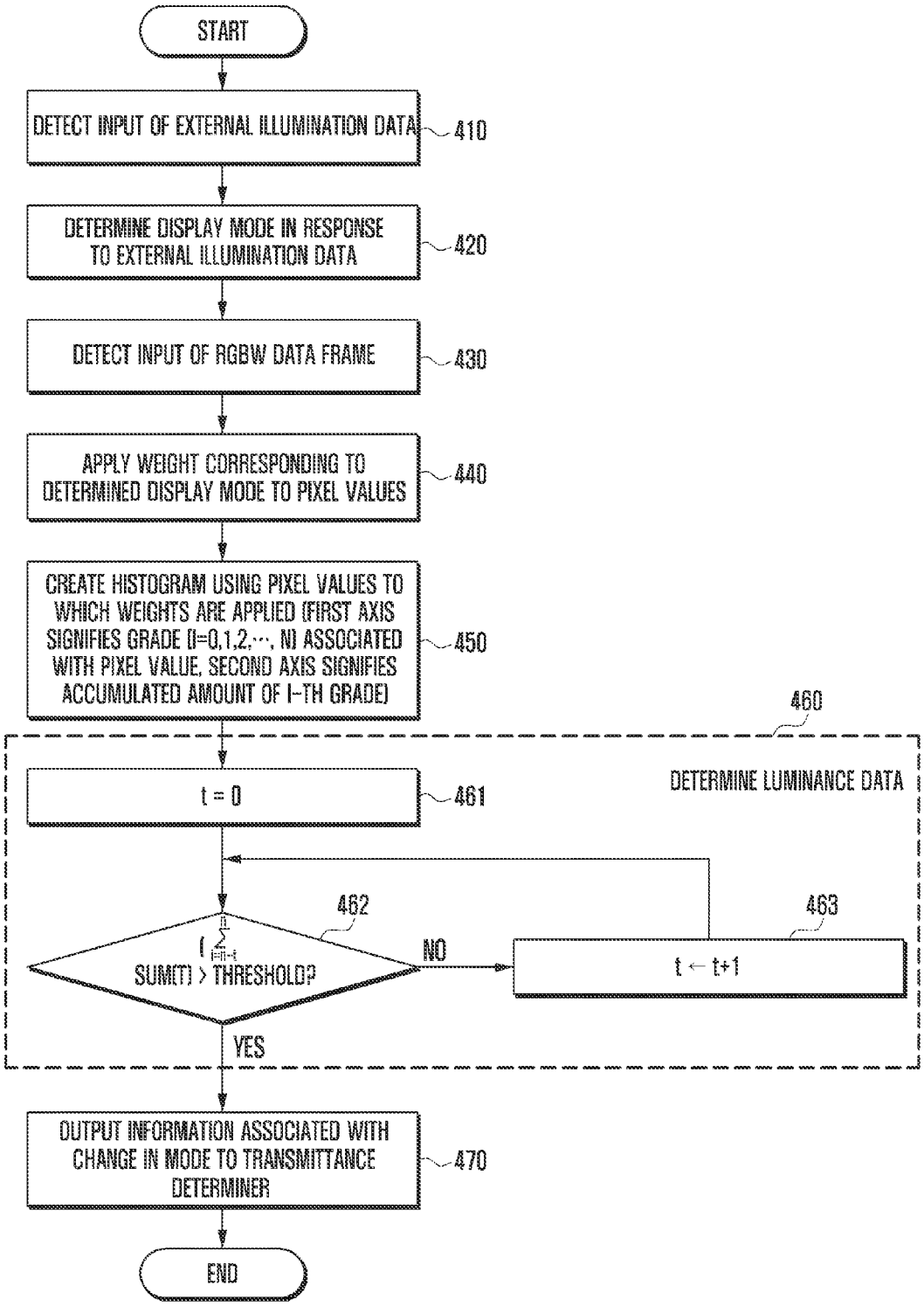
FIG. 4 is a flowchart illustrating a display control method according to an exemplary embodiment of the present invention.

FIG. 4 is a flowchart illustrating a display control method according to an exemplary embodiment of the present invention.

Referring to FIG. 4, a controller 170 detects input of external illumination data in step 410. The controller 170 determines a display mode in response to the external illumination data in step 420. For example, a first look-up table such as the look-up table illustrated in a following Table 1 is stored in a memory 140, and the controller 170 may determine the display mode with reference to the first look-up table.

TABLE 1

| | External illumination (lux) | | | | |
|---|---|---|---|---|---|
| | 0~15 (night) | 10~150 (in-door 1) | 75~1.5K (in-door 2) | 1K~20K (out-door 1) | 20K or greater (out-door 2) |
| Current consumption of BLU (%) | 100 | | 80 | 70 | 120 |
| Display mode | Basic mode | | First power saving mode | Second power saving mode(moving image playing mode) | Outdoor visibility mode |
| | | | Normal mode | | |

If the display mode is changed at step 410, the controller 170 may output information associated with change of the display mode to the transmittance determiner 152. The transmittance determiner 152 may adjust a W sub-pixel value based on display mode change information. An example with respect to the adjustment of the W sub-pixel value will be described in detail with reference to FIGS. 2 and 3.

The controller 170 may detect input of an RGBW data frame in step 430. When the input of the RGBW data frame is detected, the controller 170 applies a weight WT corresponding to the determined display mode to pixel values in step 440. Various calculation schemes are applicable to the weight applying scheme. Simply, the weight applying scheme may include a scheme in which a pixel value is multiplied by a weight. The weight WT may include sub-weights which are applied to sub-pixels values, respectively. For example, the weight WT includes a Red WT (RWT), a Green WT (GWT), a Blue WT (BWT), a Yellow WT (YWT), and a White WT (WWT).

Second and third look-up tables such as the look-up tables illustrated in Tables 2 and 3 may be stored in the memory 140, and the controller 170 may apply a weight to pixel values with reference to the second and third look-up tables.

TABLE 2

| | Register level | | |
|---|---|---|---|
| | Basic mode/Outdoor visibility mode | First power saving mode | Second power saving mode/Moving image playing mode |
| RWT | 1111 | 0111 | 0100 |
| GWT | 1111 | 0110 | 0100 |
| BWT | 1111 | 0100 | 0010 |
| YWT | 1111 | 0111 | 0110 |
| WWT | 1111 | 1010 | 1010 |

TABLE 3

| Register level | Weight (%) |
|---|---|
| 0000 | 53 |
| 0001 | 56 |
| 0010 | 59 |
| 0011 | 62 |
| 0100 | 65 |
| 0101 | 68 |
| 0110 | 72 |
| 0111 | 75 |
| 1000 | 78 |
| 1001 | 81 |
| 1010 | 84 |
| 1011 | 87 |
| 1100 | 90 |
| 1101 | 93 |
| 1110 | 96 |
| 1111 | 100 |

Referring to the Tables 2 and 3, the same weight is applied to all sub-pixel values in the basic mode and the outdoor visibility mode. A greater weight is applied to a W sub-pixel value among sub-pixel values in the first power saving mode, the second power saving mode, and the moving image playing mode. For example, the more weights are applied to a W sub-pixel value in order to make luminance (refer to B of FIG. 1) of the display panel 121 brighter while less consuming power of the backlight unit 122. For example, the R sub-pixel value is 1000, the G sub-pixel value is 900, the B sub-pixel value is 800, and the W sub-pixel value is 700. The display mode may be determined as the first power saving mode. Referring to the Tables 2 and 3, the R sub-pixel value is changed to 562 (e.g., 1000*0.75 (e.g., corresponding to RWT of first power saving mode)* 0.75 (e.g., corresponding to YWT of first power saving mode)), the G sub-pixel value is changed to 648 (e.g., 900*0.72), and the B sub-pixel value is changed to 520 (e.g., 800*0.65). The W sub-pixel value is changed to 588 (e.g., 700*0.84).

The controller 170 creates a histogram using pixel values to which weights are applied, respectively in step 450. In the histogram, a first axis (e.g., horizontal axis) corresponds to a grade (e.g., i=0, 1, 2, . . . , n) associated with a pixel value, and a second axis (e.g., vertical axis) corresponds to an accumulated amount of an i-th grade. For example, a resolution of the RGBW data frame is 1600*2560, a total accumulated amount (e.g., $$\text{SUM} = \sum_{i=0}^{q},$$

accumulated amount of an i-th grade) may be 4,096,000. In detail, the controller 170 determines the greatest value of sub-pixel values to which weights are applied as a representative value of a corresponding pixel. For example, the foregoing exemplary embodiments, the G sub-pixel value is 648 being the greatest value, which is a representative value of a corresponding pixel. A scheme of determining the representative value may be achieved by other schemes. For example, an average of the sub-pixel values may be a representative value of a corresponding pixel.

Next, the controller 170 determines a grade of the representative value, and calculates an accumulated amount of each grade. For example, when the n is 7 and the pixel value has the range from 0 to 1024, a grade of a representative value of a pixel is determined as illustrated in Table 4. Referring to FIG. 4, the grade of the representative value is determined as '5'.

TABLE 4

| | Representative value | | | | | | | |
|---|---|---|---|---|---|---|---|---|
| | 0~128 | 129~256 | 257~384 | 385~512 | 513~640 | 641~768 | 769~896 | 897~1024 |
| Grade | 0 | 1 | 2 | 3 | 4 | 5 | 6 | 7 |

The controller 170 determines luminance control data using the histogram in step 460. In detail, the controller 170 determines whether an accumulated amount of a most significant grade (e.g., seventh grade) exceeds a preset threshold. When the accumulated amount of a most significant grade exceeds the preset threshold, the controller 170 determines luminance control data based on the seventh grade. When the accumulated amount of a most significant grade is less than the preset threshold, the controller 170 sums the accumulated amount of the most significant grade and an accumulated amount of a low grade thereof. When the sum of the accumulated amount of the most significant grade and the accumulated amount of a low grade thereof exceeds the preset threshold, the controller 170 determines luminance control data based on the low grade thereof (e.g., sixth grade). A procedure of determining the luminance data will be described. The controller 170 sets a variable t for determining the luminance control data to an initial value, for example, '0' in step 461. The controller 170 determines whether an accumulated amount $$\text{sum}[t]\left( = \sum_{i=n-t}^{n} \text{ of the } i\text{-th grade}\right)$$

of the i-th grade) exceeds a threshold in step 462. In this case, the threshold may be determined by look-up tables such as the look-up tables illustrated in Tables 5 and 6. Fourth and fifth look-up tables as illustrated in the following tables 5 and 6 are stored in the memory 140, and the controller 170 may determine a threshold with reference to the fourth and fifth look-up tables.

TABLE 5

| | Basic mode/Outdoor visibility mode | First power saving mode | Second power saving mode/Moving image playing mode |
|---|---|---|---|
| THH1 | 0001 | 0010 | 1111 |
| THH2 | 1001 | 1001 | 1100 |
| THL1 | 0000 | 0010 | 1111 |
| THL2 | 1001 | 1001 | 1100 |

TABLE 6

| Register level | THH1/THL1 | Register level | THH2/THL2 |
|---|---|---|---|
| 0000 | 63 | 0000 | 16 |
| 0001 | 1087 | 0001 | 32 |
| 0010 | 2111 | 0010 | 64 |
| 0011 | 3135 | 0011 | 128 |
| ~ | ~ | ~ | ~ |
| 1100 | 12351 | 0111 | 2048 |
| 1101 | 13375 | 1000 | 4096 |
| 1110 | 14399 | 1001 | 8192 |

TABLE 6-continued

| Register level | THH1/THL1 | Register level | THH2/THL2 |
|---|---|---|---|
| 1111 | 15423 | 1010 | 16384 |
| | | 1011 or greater | Not used |

Referring to the Tables 5 and 6, for example, when the display mode is determined as the first power saving mode in a state that a threshold is set to THH1, the threshold may be determined as '2111'. When the sum[t] does not exceed the threshold (e.g., 2111), the controller 170 proceeds to step 463 in which the controller 170 sets a control variable t to 't+1' and returns to step 462. When the sum[t] exceeds the threshold (e.g., 2111), the controller 170 outputs luminance control data corresponding to an (n−t)-th grade to the backlight unit 122. For example, referring to Table 7, the controller 170 outputs '192' being luminance control data corresponding to a fourth grade to the backlight unit 122. Accordingly, the backlight unit 122 outputs light with luminance of 75%.

TABLE 7

| | Grade | | | | | | | |
|---|---|---|---|---|---|---|---|---|
| | 0 | 1 | 2 | 3 | 4 | 5 | 6 | 7 |
| BL256 (binary) | 128 | 144 | 160 | 176 | 192 | 208 | 232 | 248 |
| BL100 (%) | 50.0 | 56.25 | 62.5 | 68.75 | 75.0 | 81.25 | 87.5 | 93.75 |

When luminance of the backlight unit 122 is changed, for example, when the luminance control data are changed from '208' to '192', the controller 170 may output information associated with the change of the luminance to the transmittance determiner 152 in step 470. The transmittance determiner 152 may adjust the W sub-pixel value based on luminance change information. An exemplary embodiment of adjusting the W sub-pixel value will be described in detail with reference to FIGS. 2 and 3.

Figure 5:
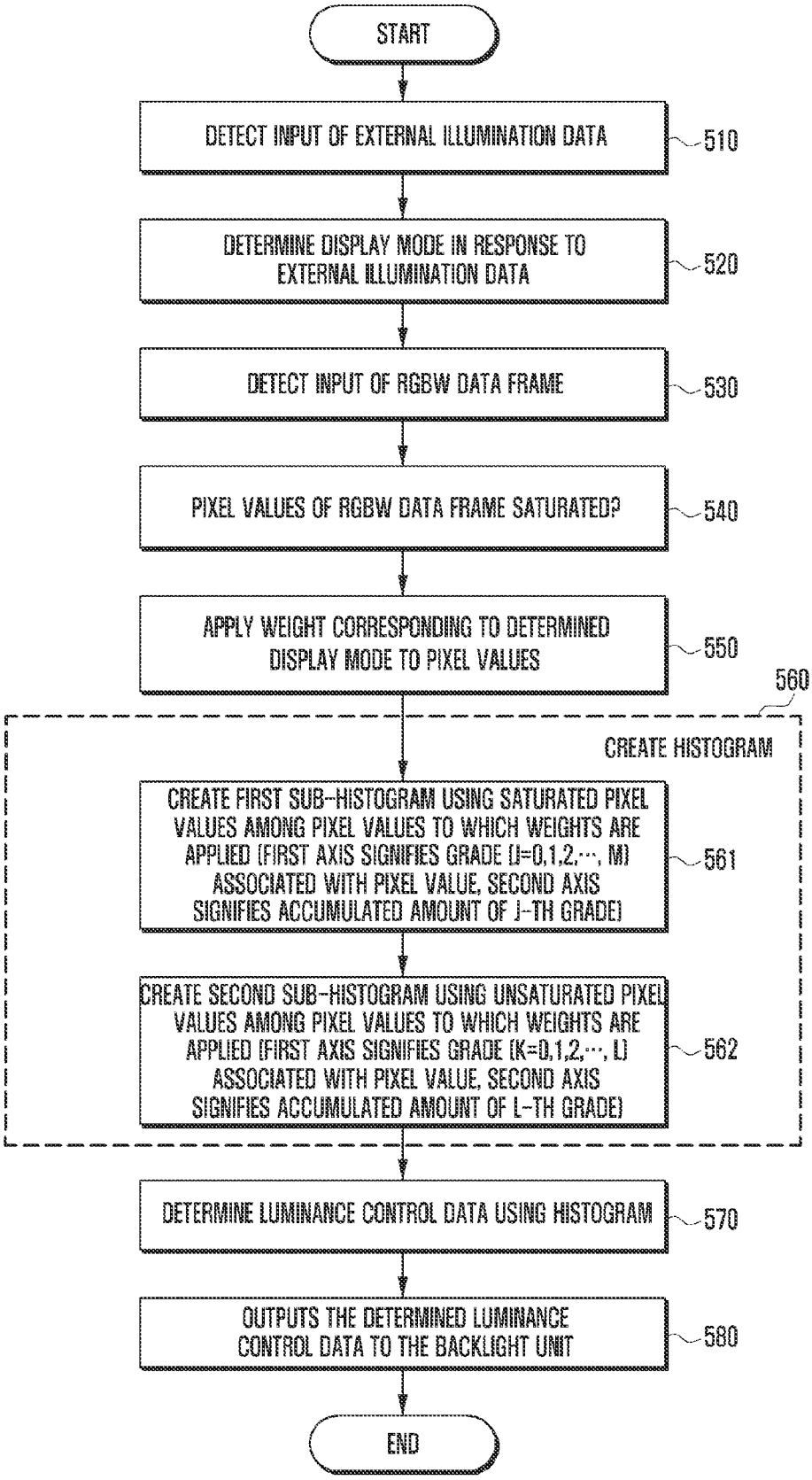
FIG. 5 is a flowchart illustrating a display control method according to an exemplary embodiment of the present invention.

FIG. 5 is a flowchart illustrating a display control method according to an exemplary embodiment of the present invention.

Referring to FIG. 5, a controller 170 detects input of external illumination data in step 510. The controller 170 determines a display mode in response to the external illumination data in step 520. If the display mode is changed at step 520, the controller 170 may output information associated with the change in the display mode to the transmittance determiner 152. The transmittance determiner 152 may adjust a W sub-pixel value based on display mode change information. An exemplary embodiment of the present invention for adjusting the W sub-pixel value was described in detail with reference to FIGS. 2 and 3.

The controller 170 may detect input of an RGBW data frame in step 530. When the input of an RGBW data frame is detected, the controller 170 determines whether pixel values of the RGBW data frame are saturated in step 540. For example, when a corresponding pixel value represents an achromatic color (e.g., when the sub-pixel value are the same), the controller 170 determines a corresponding pixel value as non-saturation. When the corresponding pixel value represents a chromatic color (e.g., when a difference between at least two of the sub-pixel values are 100 or greater), the controller 170 determines the corresponding pixel value as saturation.

The controller 170 applies a weight WT corresponding to the determined display mode to pixel values in step 550.

An exemplary embodiment of the weight applying scheme was described in detail with reference to the Tables 2 and 3.

The controller 170 creates a histogram using pixel values to which weights are applied, respectively in step 560. The histogram may include a first sub-histogram and a second sub-histogram.

Figure 6:
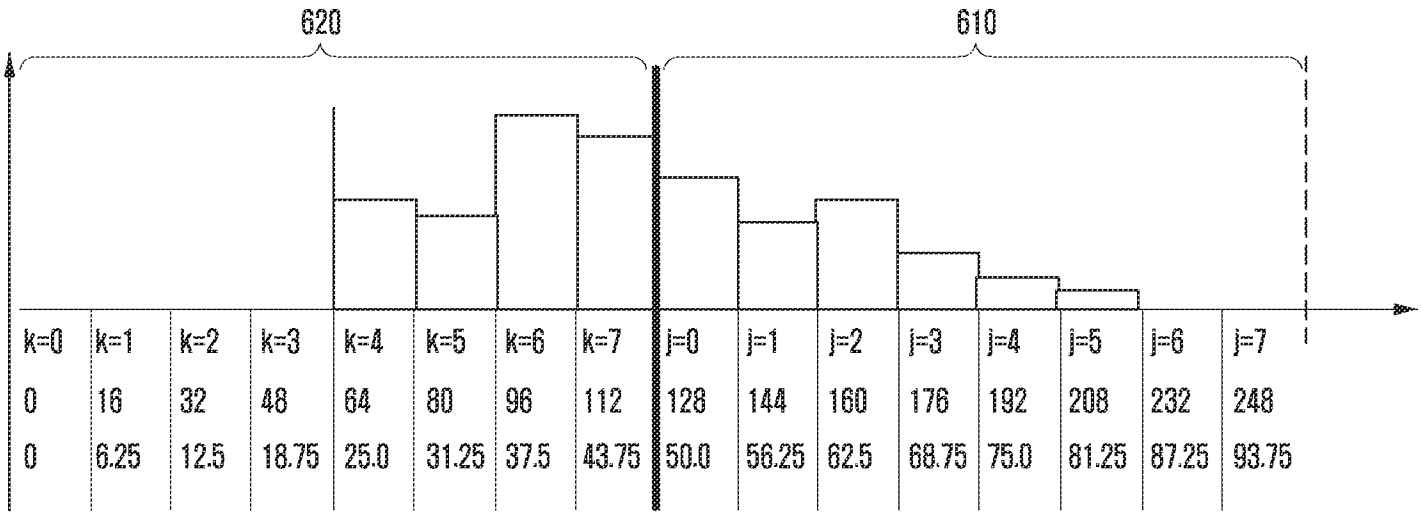
FIG. 6 is a histogram of an image according to an exemplary embodiment of the present invention.

FIG. 6 is a histogram of an image according to an exemplary embodiment of the present invention.

Referring to FIGS. 5 and 6, in step 561, the controller 170 creates a first sub-histogram 610 using saturated pixel values (i.e., a representative value representing respective pixels; refer to step 450) among pixel values to which weights are applied. In the first sub-histogram 610, a first axis (e.g., horizontal axis) signifies a grade (j=0, 1, 2, . . . , m) associated with a pixel value, m may be a number corresponding to a most significant grade of the first sub-histogram and a second axis (e.g., vertical axis) signifies an accumulated amount of a j-th grade. In step 562, the controller 170 creates a second sub-histogram 620 using unsaturated pixel values (i.e., a representative value representing respective pixels; refer to step 450) among pixel values to which weights are applied. In the second sub-histogram 620, a first axis (e.g., horizontal axis) signifies a grade (k=0, 1, 2, . . . , l) associated with a pixel value, l may be a number corresponding to a most significant grade of the second sub-histogram and a second axis (e.g., vertical axis) signifies an accumulated amount of a k-th grade.

The controller 170 determines luminance control data using the histogram in step 570. A detail procedure of step 570 will be described with reference to FIGS. 7 and 8. The controller 170 outputs the determined luminance control data to the backlight unit 122 in step 580. When the luminance of the backlight unit 122 is changed at step 580, for example, when the luminance control data are changed from '208' to '192' (refer to table 7), the controller 170 may output information associated with the change in the luminance to the transmittance determiner 152. The transmittance determiner 152 may adjust the W sub-pixel value based on the luminance change information. An exemplary embodiment of adjusting the W sub-pixel value was described in detail with reference to FIGS. 2 and 3.

Figure 7:
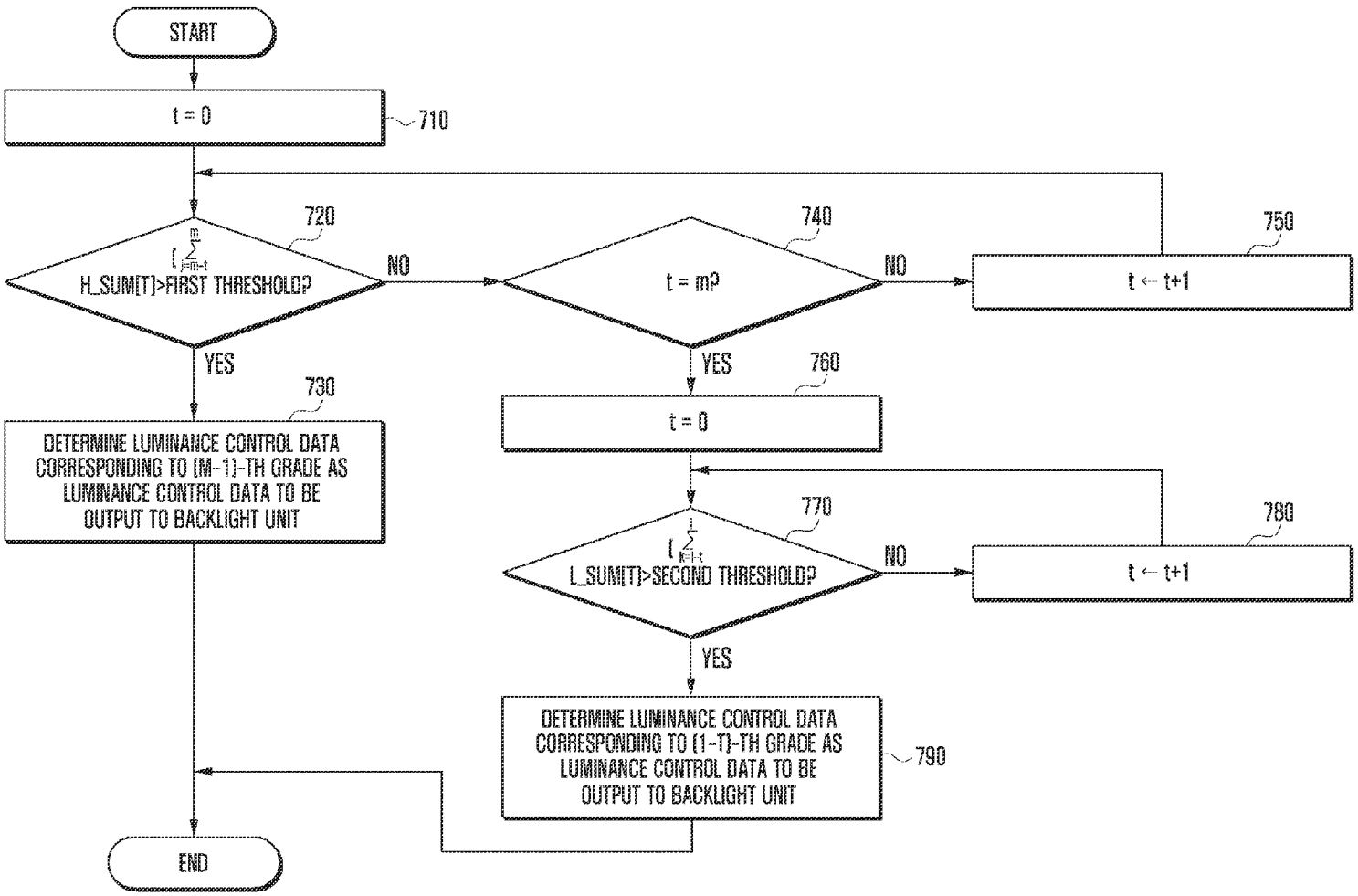
FIG. 7 is a flowchart illustrating a luminance determining method according to an exemplary embodiment of the present invention.
Figure 8:
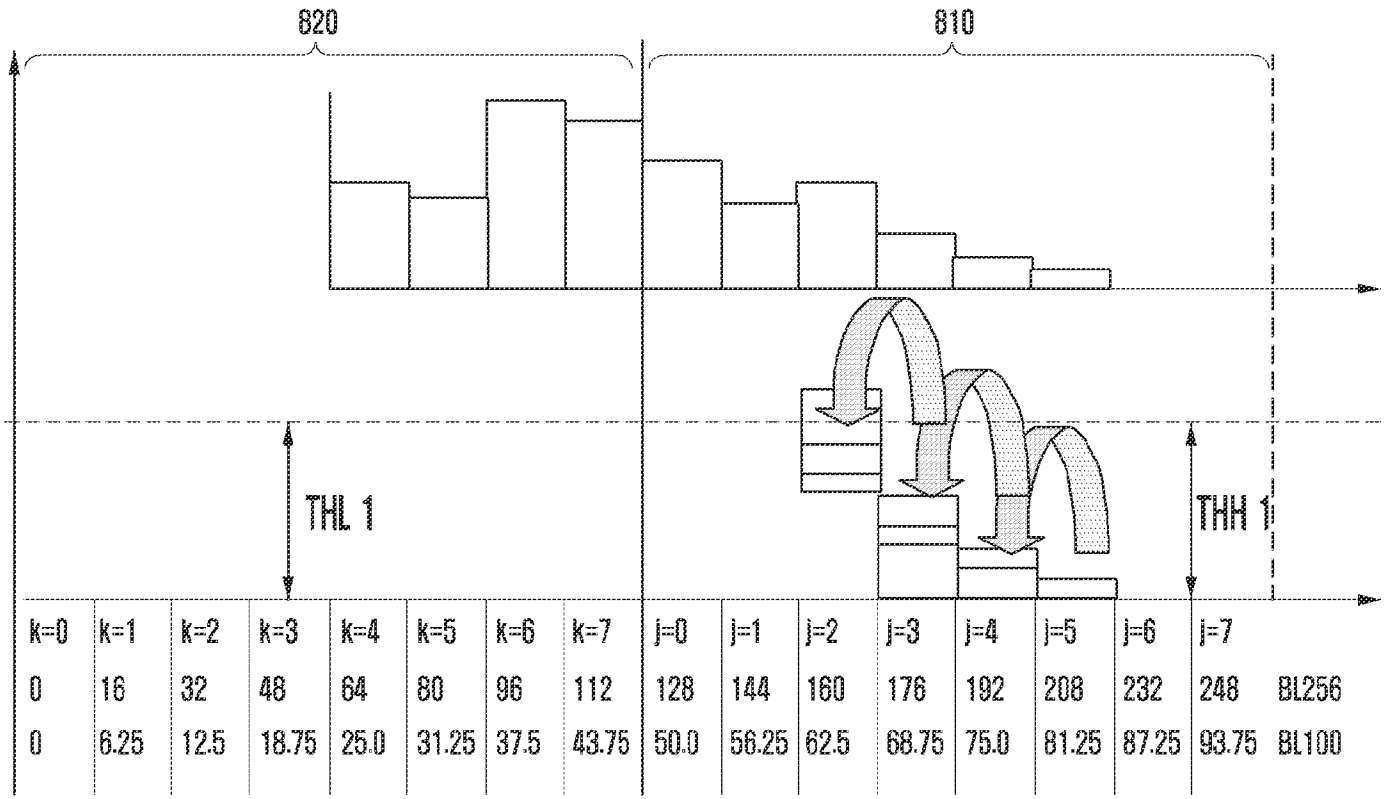
FIG. 8 is a histogram illustrating a luminance determining method according to an exemplary embodiment of the present invention.

FIG. 7 is a flowchart illustrating a luminance determination method according to an exemplary embodiment of the present invention. FIG. 8 is a histogram illustrating a histogram illustrating a luminance determination method according to an exemplary embodiment of the present invention.

Referring to FIGS. 7 and 8, a controller 170 sets a control variable t to one of j values, for example, '0' in step 710. The controller 170 determines whether $$\text{H_sum}[t]\left(=\sum_{i=m-t}^{m}\text{ an accumulated amount of a } j\text{-th grade}\right)$$

an accumulated amount of a j-th grade) exceeds a first threshold in step 720. In this case, the first threshold may be determined by look-up tables such as the look-up tables illustrated in Tables 5 and 6. For example, when the display mode is determined as the first power saving mode in a state that a first threshold is set to THH1, the controller 170 determines the first threshold as '2111'.

When the H_sum[t] exceeds the first threshold (e.g., 2111), the process proceeds to step 730. Proceeding to step 730 signifies that a corresponding RGBW data frame is chromatic as a whole. The controller 170 determines luminance control data corresponding to an (m−1)-th grade as luminance control data to be output to the backlight unit 122 in step 730. Referring to FIG. 8, for example, the controller 170 determines '192' being luminance control data corresponding to a fourth grade as luminance control data to be output to the backlight unit 122 in step 730. Accordingly, the backlight unit 122 outputs light with luminance of 75%.

As described above, the luminance of the backlight unit 122 may be determined using the first threshold (e.g., 'THH1)'. In this case, the luminance may be more minutely determined using THH2. For example, the controller 170 calculates an excess amount exceeding the THH1 in the H_sum[t]. For example, when the H_sum[t] is 3000 and the THH1 is 2111, the excess amount is 899. When the display mode is the first power saving mode, the THH2 is 8192. When the excess amount exceeds the THH2, the controller 170 outputs the determined luminance control data (e.g., 192) to the backlight unit 122.

In contrast, when the excess amount does not exceed the THH2, the controller 170 reduces the determined luminance control data (e.g., adjust in the range of 176 to 192; refer to the first histogram 810 of FIG. 8), and outputs the reduced luminance control data to the backlight unit 122. In this case, the reduced extent may be determined in proportion to the excess amount. Accordingly, the backlight unit 122 may output light with another luminance.

When the H_sum[t] does not exceed the first threshold (e.g., 2111) in step 720, the controller 170 determines whether the control variable t is set to 'm' (e.g., m is greater than an initial value of the control variable, and is a number (e.g., 7) corresponding to the most significant grade of the first histogram 810) in step 740. When the control variable t is not equal to m (e.g., when the control variable t is smaller than the m) in step 740, the controller 170 sets the control variable t to 't+1' in step 750 and returns to step 720. In contrast, when the control variable t is the same as the m in step 740, the process proceeds to step 760. Proceeding to step 760 signifies that a corresponding RGBW data frame is achromatic as a whole.

The controller 170 sets the control variable t to one of k values, for example, '0' in step 760. The controller 170 determines whether $$\text{L_sum}[t]\left(=\sum_{i=l-t}^{l}\text{ an accumulated amount of } k\text{-th grade}\right)$$

an accumulated amount of k-th grade) exceeds a second threshold in step 770. The second threshold may be determined by look-up tables such as the look-up tables illustrated in Tables 5 and 6. For example, when the display mode is determined as the first power saving mode in a state that a second threshold is set to THL1, the controller 170 determines the second threshold as '2111'. When the L_sum [t] does not exceed the second threshold (e.g., 2111) in step 770, the controller 170 sets the control variable t to 't+1' in step 780 and returns to step 770.

When the L_sum[t] exceeds the second threshold (e.g., 2111) in step 77, the controller 170 determines luminance control data corresponding to a (1−t)-th grade as luminance control data to be output to the backlight unit 122 in step 790. Referring to FIG. 8, for example, the controller 170 determines '64' being luminance control data corresponding to the fourth grade as luminance control data to be output to the backlight unit 122. Accordingly, the backlight unit 122 outputs light with luminance of 25%.

As described above, the luminance of the backlight unit 122 may be determined using the second threshold (i.e., 'THL1'). In this case, the luminance may be more minutely determined using THL2. For example, the controller 170 calculates an excess amount exceeding the THL1 in the L_sum[t]. For example, when the L_sum[t] is 3000 and the THL1 is 2111, the excess amount is 899. When the display mode is the first power saving mode, the THL2 is 8192. When the excess amount exceeds the THL2, the controller 170 outputs the determined luminance control data (e.g., 64) to the backlight unit 122. In contrast, when the excess amount does not exceed the THL2, the controller 170 reduces the determined luminance control data (e.g., adjust in the range of 48 to 64; refer to the second histogram 820 of FIG. 8), and outputs the reduced luminance control data to the backlight unit 122. In this case, the reduced extent may be determined in proportion to the excess amount. Accordingly, the backlight unit 122 may output light with another luminance.

Figure 9:
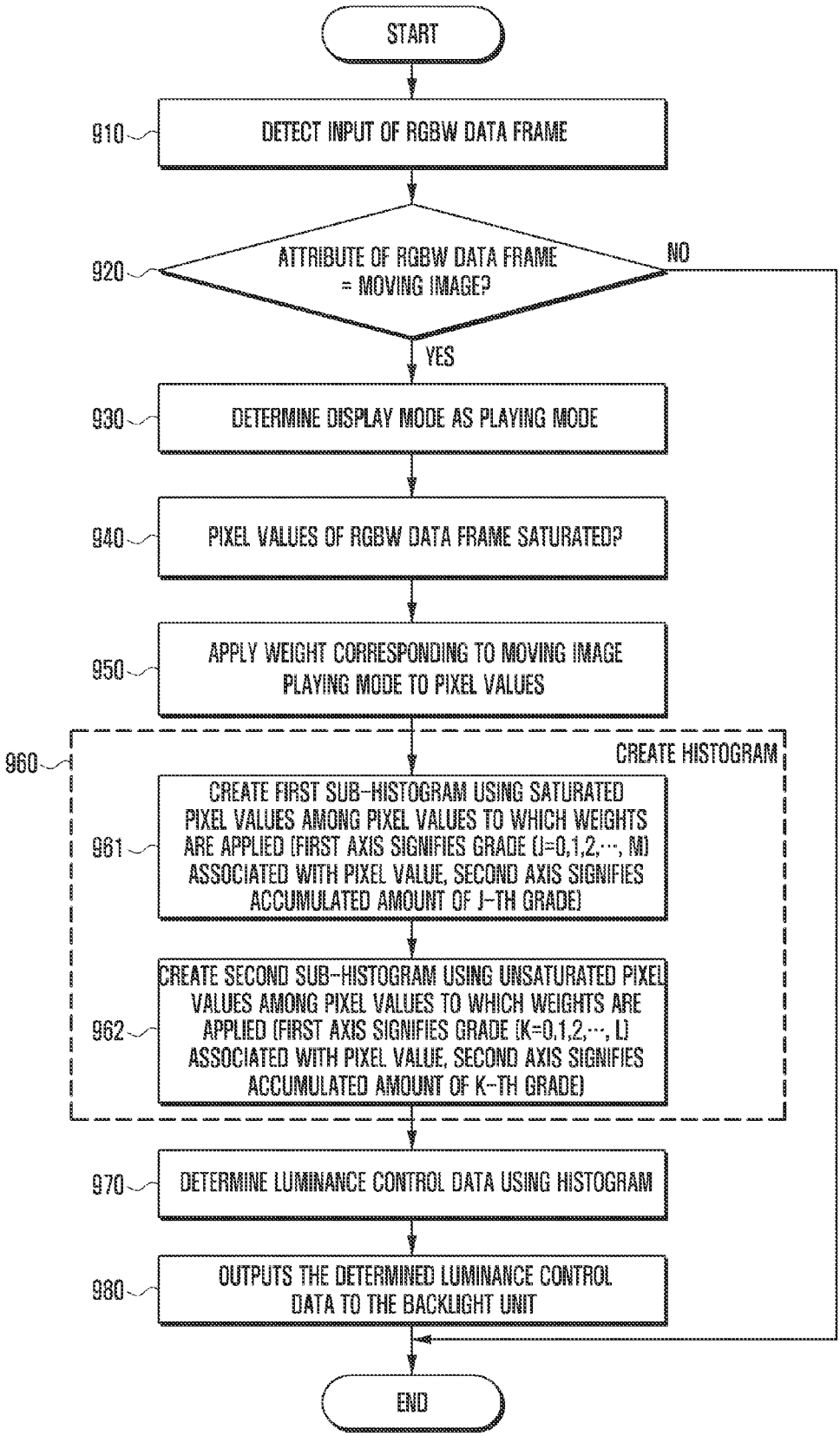
FIG. 9 is a flowchart illustrating a luminance determining method according to an exemplary embodiment of the present invention.

FIG. 9 is a flowchart illustrating a luminance determining method according to an exemplary embodiment of the present invention.

Referring to FIG. 9, a controller 170 detects input of an RGBW data frame in step 910. The controller 170 determines whether an attribute of the RGBW data frame corresponds to a moving image in response to the input of the RGBW data frame in step 920. For example, the controller 170 may determine presence of the moving image through image attribute information corresponding to an input RGBW data frame.

When the attribute of the RGHW data frame corresponds to a moving image in step 920, the controller 170 determines the display mode as a moving image playing mode in step 930. As listed in the Tables 2 and 5, values in the moving image playing mode may be the same as those in the second power saving mode. For example, the weights and thresholds may be identically set with the second power saving mode. Undoubtedly, the weights and the thresholds may be set in the moving image playing mode separately from the second power saving mode.

The controller 170 determines whether pixel values of the RGBW data frame are saturated in step 940.

The controller 170 applies a weight WT corresponding to the moving image playing mode to pixel values in step 950. A weight applying scheme according to an exemplary embodiment of the present invention was described in detail with reference to Tables 2 and 3.

The controller 170 creates a histogram using pixel values to which the weight is applied in step 960. Step 960 includes a step 961 of creating a first sub-histogram and a step 962 of creating a second sub-histogram. Steps 961 and 962 are the same as steps 561 and 562 as described above, and thus a detailed description thereof is omitted.

The controller 170 determines luminance control data using the histogram in step 970. A detailed procedure of step 970 is the same as that of step 570 described with reference to FIGS. 7 and 8, and thus a detailed description thereof is omitted. The controller 170 outputs the determined luminance control data to the backlight unit 122 in step 980.

Figure 10:
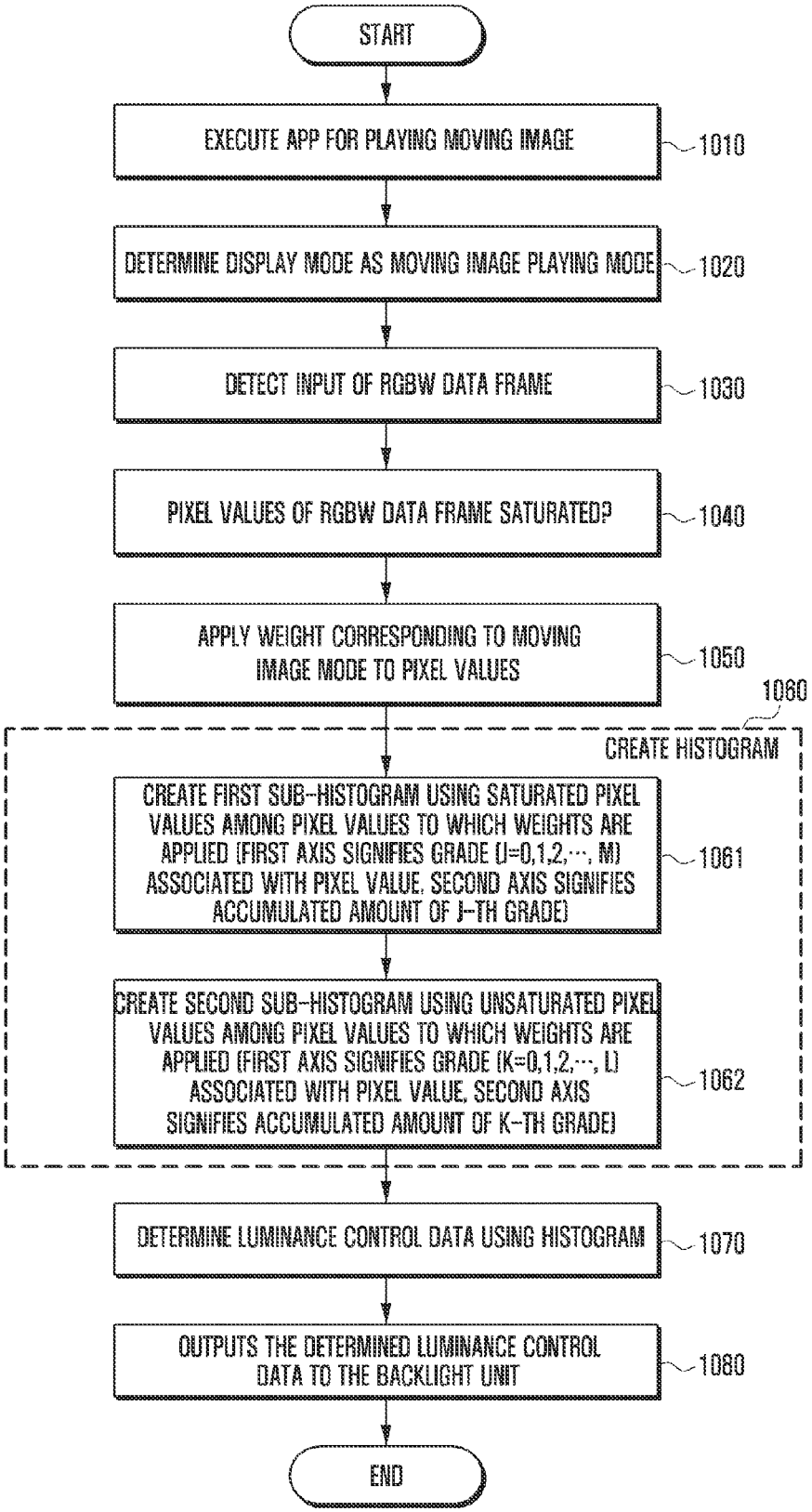
FIG. 10 is a flowchart illustrating a luminance determining method according to an exemplary embodiment of the present invention.

FIG. 10 is a flowchart illustrating a luminance determining method according to an exemplary embodiment of the present invention.

Referring to FIG. 10, a display unit 120 may display a home screen under control of a controller 170. The controller 170 may detect selection of an icon (e.g., tapping a corresponding icon) corresponding to an application for playing a moving image from the home screen. The controller 170 executes a corresponding App in response to selection of an icon corresponding to a moving image playing application in step 1010. A touch screen may display an execution screen of the application under control of the controller 170.

The controller 170 determines a display mode as a moving image playing mode in response to execution of a moving image playing App in step 1020. In this case, as listed in the Table 2 and 5, values in the moving image playing mode may be the same as those in the second power saving mode. For example, the weights and thresholds may be identically set with the second power saving mode. Undoubtedly, the weights and the thresholds may be set in the moving image playing mode, separately from the second power saving mode.

The controller 170 may detect input of an RGBW data frame in step 1030. The controller 170 determines whether pixel values of the RGBW data frame are saturated in step 1040. The controller 170 applies a weight WT corresponding to the moving image mode to pixel values in step 1050. An example of the weight applying scheme was described in detail with reference to Tables 2 and 3.

The controller 170 creates a histogram using pixel values to which weights are applied, respectively in step 1060. Step 1060 includes a step 1061 of creating a first sub-histogram and a step 1062 of creating a second sub-histogram. Steps 1061 and 1062 are the same as steps 561 and 562 as described above, and thus a detailed description thereof is omitted.

The controller 170 determines luminance control data using the histogram in step 1070. A detailed procedure of step 1070 is the same as that of step 570 described with reference to FIGS. 7 and 8, and thus a detailed description thereof is omitted. The controller 170 outputs the determined luminance control data to the backlight unit 122 in step 1080.

Figure 11:
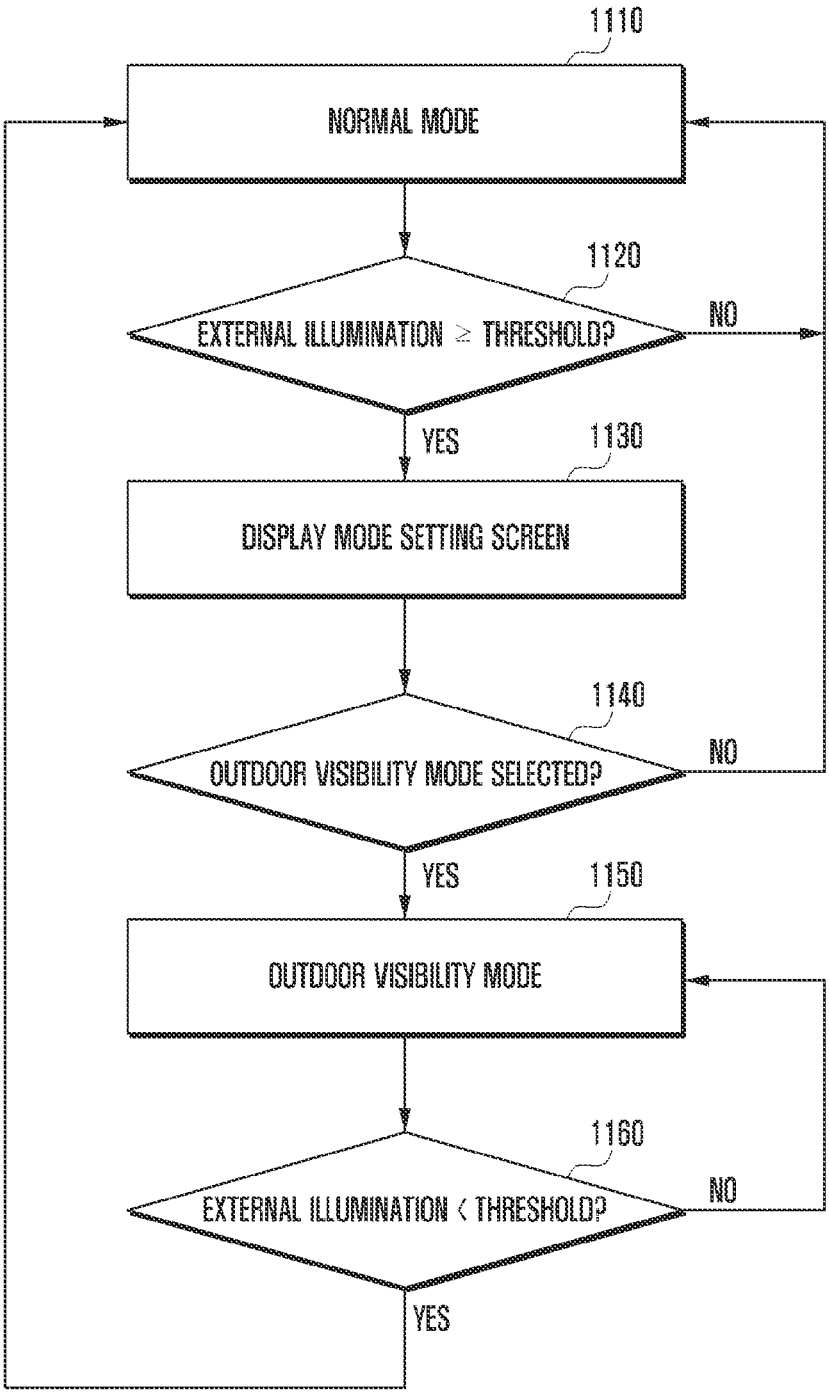
FIG. 11 is a flowchart illustrating a luminance determining method according to an exemplary embodiment of the present invention.

FIG. 11 is a flowchart illustrating a luminance determining method according to a fifth exemplary embodiment of the present invention.

Referring to FIG. 11, the controller 170 may operate a display mode of the display control apparatus 100 as a normal mode in step 1110. For example, as described above, the controller 170 determines transmittance of the display panel 121 corresponding to a normal mode, and determines luminance of a backlight unit 122. As listed in the table 1, the normal mode may be one of a basic mode, a first power saving mode, and a second power saving mode.

The controller 170 determines whether external illumination (lux) is equal to or greater than a threshold (e.g., 20K; refer to Table 1) in step 1120. When the external illumination is less than the threshold, the process returns to step 1110.

In contrast, when the external illumination is equal to or greater than the threshold, the controller 170 controls the display unit 120 to display a mode setting screen in step 1130.

The controller 170 may determine whether an outdoor visibility mode is selected (e.g., tapping a corresponding button) from the mode setting screen in step 1140.

When the outdoor visibility mode is not selected (e.g., tapping for minimum button is detected), the process may return to step 1110.

When the outdoor visibility mode is selected, the controller 170 may operate the display mode of the display control apparatus 100 as the outdoor visibility mode in step 1150. In general, when external illumination around the display control apparatus 100 is high (e.g., 20K lux or higher), visibility of a displayed image is significantly lowered. Particularly, a simultaneous contrast error occurs in which color tone is differently viewed by human eyes. For example, when a yellow is displayed and a white is displayed around the yellow, as white luminance is increased in order to increase total luminance in a state that yellow luminance is fixed, the simultaneous contrast error where the yellow is recognized as a dark color occurs. As described above, the controller 170 determines transmittance of a display panel 121 corresponding to the outdoor visibility mode (e.g., control to increase transmittance of the W sub-pixel), and determines luminance of the backlight unit 122 (e.g., increases consumption current from 20 mA (100%) to 23 mA (120%)) to suppress the simultaneous contrast error. Particularly, the controller 170 further increases a W sub-pixel value of a yellow rather than a white (e.g., a color having a relatively high saturation relative to a white to suppress the simultaneous contrast error). Further, the controller 170 controls the backlight unit 122 to consume a maximum current (e.g., 23 mA) so that the simultaneous contrast error is suppressed.

The controller 170 determines whether external illumination is less than the threshold in step 1160. When the external illumination is less than the threshold, the process returns to step 1110. In contrast, when the external illumination is equal to or greater than the threshold, the process returns to step 1150.

The foregoing method for display control of exemplary embodiments of the present invention may be implemented in an executable program command form by various computer means and be recorded in a non-transitory computer readable recording medium. In this case, the computer readable recording medium may include a program command, a data file, and a data structure individually or a combination thereof. In the meantime, the program command recorded in a recording medium may be specially designed or configured for the present invention or be known to a person having ordinary skill in a computer software field to be used. The computer readable recording medium includes Magnetic Media such as hard disk, floppy disk, or magnetic tape, Optical Media such as Compact Disc Read Only Memory (CD-ROM) or Digital Versatile Disc (DVD), Magneto-Optical Media such as floptical disk, and a hardware device such as ROM. RAM, flash memory storing and executing program commands. Further, the program command includes a machine language code created by a complier and a high-level language code executable by a computer using an interpreter. The foregoing hardware device may be configured to be operated as at least one software module to perform an operation of the present invention.

As mentioned above, the display control method and the apparatus thereof according to exemplary embodiments of the present invention may dynamically control the display unit in response to at least one of variation in the external illumination (e.g., move from indoor to outdoor) and variation in image attribute (e.g., playing of moving image) to save power consumption while maintaining image quality.

While the invention has been shown and described with reference to certain exemplary embodiments thereof, it will be understood by those skilled in the art that various changes in form and details may be made therein without departing from the spirit and scope of the present invention as defined by the appended claims and their equivalents.

What is claimed is:

1. A display control method of a device including a pentile Red-Green-Blue-White (RGBW) type display panel and a lighting system providing light to the display panel, the method comprising:

determining a display mode based on external illumination data;

detecting input of an RGBW data frame;

applying a weight corresponding to the determined display mode to at least a White (W) sub-pixel value among pixel values of the RGBW data frame;

determining luminance control data using the pixel values to which the weight is applied;

controlling the lighting system to output light based on the determined luminance control data; and controlling the display panel to transmit the light based on the determined luminance control data, wherein the applying of the weight comprises applying a greater weight to a W sub-pixel value among a Red (R) sub-pixel value, a Green (G) sub-pixel value, a Blue (B) sub-pixel value, and the W sub-pixel value.

2. The method of claim 1, further comprising creating a histogram using the pixel values to which the weight is applied, wherein the creating of the histogram comprises a first sub-histogram using saturated pixel values among the pixel values to which the weight is applied, and creating a second sub-histogram using non-saturated pixel values among the pixel values to which the weight is applied, wherein in the first sub-histogram, a first axis corresponds to a grade (j=0, 1, 2, . . . , m) associated with a pixel value, and a second axis corresponds to an accumulated amount of a j-th grade, and wherein in the second sub-histogram, a first axis corresponds to a grade (k=0, 1, 2, . . . , l) associated with a pixel value, and a second axis corresponds to an accumulated amount of an l-th grade.

3. The method of claim 2, wherein the determining of the luminance control data comprises:

setting a control variable 't' to a j value from the histogram;

determining whether an accumulated amount of a j-th grade exceeds a first threshold;

when the accumulated amount of a j-th grade exceeds the first threshold, determining luminance control data corresponding to a (m-t)-th grade in the first sub-histogram as luminance control data for controlling the lighting system and the display panel;

when the accumulated amount of a j-th grade does not exceed the first threshold and the control variable 't' is the 'm', setting the control variable 't' to one of the k values;

determining whether an accumulated amount of a k-th grade exceeds a second threshold; and when the accumulated amount of a k-th grade exceeds the second threshold, determining luminance control data corresponding to a (1-t)-th grade in the second sub-histogram as luminance control data for controlling the lighting system and the display panel.

4. The method of claim 3, wherein the first threshold and the second threshold are determined according to the determined display mode.

5. The method of claim 1, wherein the determining of the display mode comprises:

displaying a mode setting screen when external illumination exceeds a threshold for determining an outdoor visibility mode among thresholds associated with the determining of the display mode;

detecting selection of the outdoor visibility mode from the mode setting screen; and determining the display mode as the outdoor visibility mode in response to the selection of the outdoor visibility mode.

6. A display control method of a device including a pentile Red-Green-Blue-White (RGBW) type display panel and a lighting system providing light to the display panel, the method comprising:

detecting input of external illumination data;

displaying a mode setting screen when the external illumination data exceeds a threshold for determining an outdoor visibility mode;

detecting selection of the outdoor visibility mode from the mode setting screen;

determining a display mode based on the selection of the outdoor visibility mode;

controlling the display panel to increase transmittance of a White (W) sub-pixel; and controlling the lighting system to increase luminance in response to the determining that the display mode corresponds to the outdoor visibility mode, wherein the controller is further configured to apply greater weight to the W sub-pixel value among a Red (R) sub-pixel value, a Green (G) sub-pixel value, a Blue (B) sub-pixel value, and the W sub-pixel value.

7. The method of claim 6, wherein the controlling of the lighting system comprises controlling the lighting system to output light with maximum luminance set to the lighting system.

8. An apparatus comprising:

a display unit for including a pentile Red-Green-Blue-White (RGBW) type display panel and a lighting system for providing light to the display panel;

an image processor for adjusting transmittance of the display panel;

an optical sensor for detecting external illumination; and a controller configured to:

determine a display mode based on the external illumination, apply a weight corresponding to the determined display mode to at least White (W) sub-pixel value among sub-pixel values of pixel values of RGBW data frame input from the image processor, determine luminance control data using the pixel values to which the weight is applied, control the lighting system to output light based on the determined luminance control data, control the display panel to transmit the light based on the determined luminance control data, and apply greater weight to a W sub-pixel value among a Red (R) sub-pixel value, a Green (G) sub-pixel value, a Blue (B) sub-pixel value, and the W sub-pixel value.

9. The apparatus of claim 8, further comprising a memory for storing a weight RWT corresponding to the R sub-pixel value, a weight GWT corresponding to the G sub-pixel value, a weight BWT corresponding to the B sub-pixel value, and a weight WWT corresponding to the W sub-pixel value by display modes classified according to the external illumination.

10. The apparatus of claim 9, wherein the controller is further configured to control the display unit to display a mode setting screen when external illumination exceeds a threshold for determining an outdoor visibility mode among thresholds associated with the determining of the display mode, detect selection of the outdoor visibility mode from the mode setting screen, and determine that the display mode corresponds to the outdoor visibility mode in response to the selection of the outdoor visibility mode.

11. A display control apparatus comprising:

a display unit for including a pentile Red-Green-Blue-White (RGBW) type display panel and a lighting system providing light to the display panel;

an image processor for adjusting transmittance of the display panel;

an optical sensor for detecting external illumination; and a controller configured to:

control the display unit to display a mode setting screen when external illumination data from the optical sensor exceed a threshold for determining an outdoor visibility mode, detect selection of the outdoor visibility mode from the mode setting screen, determine a display mode based on the selection of the outdoor visibility mode, control the display panel to increase transmittance of a White (W) sub-pixel based on the display mode, control the lighting system to increase luminance through the image processor in response to the determining of the outdoor visibility mode, and apply greater weight to the W sub-pixel value among a Red (R) sub-pixel value, a Green (G) sub-pixel value, a Blue (B) sub-pixel value, and the W sub-pixel value.

12. The apparatus of claim 11, wherein the controller is further configured to control the lighting system to output light with maximum luminance set to the lighting system in response to the determining of the outdoor visibility mode.

13. A non-transitory computer-readable recoding medium implemented by a device including a pentile Red-Green-Blue-White (RGBW) type display panel and a lighting system providing light to the display panel, the recoding medium storing instructions that, when executed, causes at least one processor to perform a method comprising:

determining a display mode in response to input of external illumination data;

detecting input of an RGBW data frame;

applying a weight corresponding to the determined display mode to at least White (W) sub-pixel value among sub-pixel values of pixel values of the RGBW data frame;

determining luminance control data using the pixel values to which the weight is applied;

controlling the lighting system to output light based on the determined luminance control data; and controlling the display panel to transmit the light based on the determined luminance control data, wherein controlling of the display panel comprises applying a greater weight to the W sub-pixel value among a Red (R) sub-pixel value, a Green (G) sub-pixel value, a Blue (B) sub-pixel value, and the W sub-pixel value.

* * * * *